US005244018A

United States Patent [19]

Hasselmann

[11] Patent Number: 5,244,018

[45] Date of Patent: Sep. 14, 1993

[54] BELLOWLESS VAPOR RECOVERY NOZZLE

[76] Inventor: Detlev E. M. Hasselmann, 519 S. Nardo, Solana Beach, Calif. 92075

[21] Appl. No.: 927,132

[22] Filed: Aug. 7, 1992

[51] Int. Cl.[5] ..... B65B 31/00

[52] U.S. Cl. ..... 141/59; 141/44; 141/392

[58] Field of Search ..... 141/44, 45, 46, 59, 141/206, 207, 208, 209, 210, 218, 392, 98

[56] References Cited

U.S. PATENT DOCUMENTS 3,100,007 8/1963 Reasby ..... 141/209
3,603,359 9/1971 Belue ..... 141/209
4,351,375 9/1982 Polson ..... 141/98
4,505,308 3/1985 Walker et al. ..... 141/59

*Primary Examiner*—Henry J. Recla
*Assistant Examiner*—David J. Walczak
*Attorney, Agent, or Firm*—Baker, Maxham, Jester & Meador

[57] ABSTRACT

A bellowless gasoline dispensing nozzle having coaxial conduits to reduce the vapor leakage from gas tank vent tubes. The reduction in vapor leakage is accomplished by a set of holes in the outer conduit sized and positioned to draw in vapors from the outlet of the gas tank vent tube on vehicles in which this outlet is placed outside the no-lead restriction plate.

13 Claims, 2 Drawing Sheets

FIG. 3
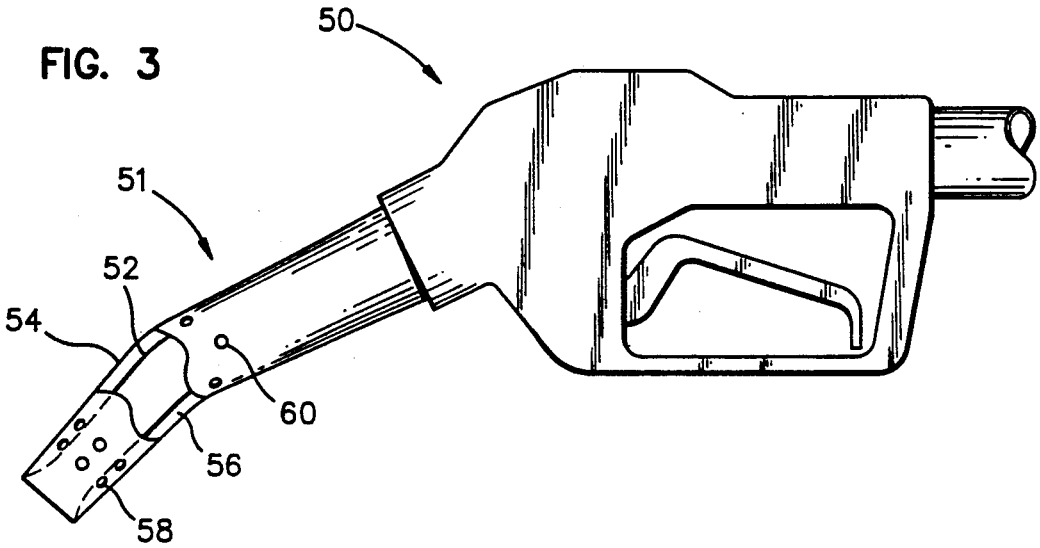
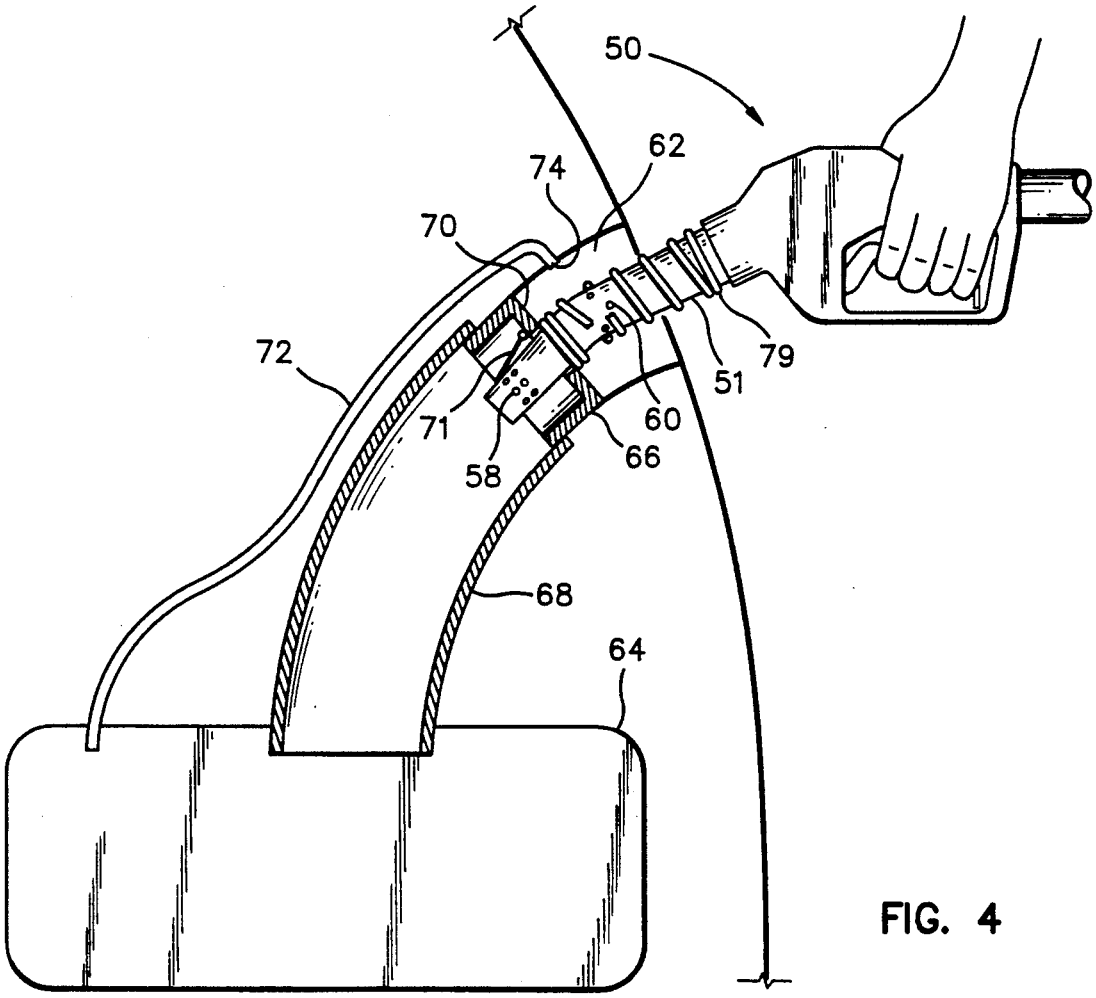
FIG. 4

BELLOWLESS VAPOR RECOVERY NOZZLE

FIELD OF THE INVENTION

This invention relates generally to vapor recovery nozzles, and more particularly to dual spout bellowless nozzles where the vapor is recovered through a passageway adjacent to or concentric with the liquid dispensing passageway.

BACKGROUND OF THE INVENTION

Gasoline or other liquid dispensing nozzles are commonly provided with vapor recovery systems to lessen the amount of volatile or otherwise undesirable vapor that escapes into the atmosphere when the liquid is dispensed. With specific reference to gasoline dispensing nozzles, such vapor recovery systems most commonly use a nozzle with a rubber bellows concentrically enclosing the spout. The space between the bellows and the spout is connected to a vacuum system, which draws in the vapors existing at the opening to the fill neck and prevents them from escaping and polluting the atmosphere.

Gasoline dispensing nozzles with bellows have certain practical limitations. The bellows are bulky, awkward, and expensive. The bellows also make it harder for users to insert and hold the spout in their vehicles' gasoline inlets. Bellowless nozzles have thus been proposed, as for example, in U.S. Pat. No. 4,351,375. A typical nozzle 10 of this type known in the art is depicted in FIG. 1. Such nozzles typically have coaxial inner and outer spouts 12, 14 of approximately circular cross-section. A vacuum system (not shown) is connected to space 16 between the inner and outer spouts in known manner. Vapor is drawn into this space through a plurality of holes 18 adjacent the distal end of the outer spout.

FIG. 2 depicts a typical motor vehicle gasoline inlet with vent tube. Gasoline tank 22 has main tube 24 connecting the tank to fill neck 26. A no-lead restriction plate 30 is located inside the fill neck, which has a circular opening 34 and a hinged trap door 37 sized to prevent users from inserting dispensing spouts of the larger size used for leaded gasoline. Coil spring 35 prevents the spout from entering the fill neck beyond the desired distance. There is also a vent tube 32, which allows vapor to escape from the top of the gas tank through opening 39. This tube allows vapors to escape from the tank without having to flow against the flow of gasoline pouring down the fill neck. Because opening 39 is on the gas tank side of restriction plate 30, the vapors vented through it can be drawn into nozzle 40 through holes 42.

In many vehicles, however, the gas tank vent tube does not open on the gas tank side of the restriction plate. Rather the tube opening is located on the side of the restriction plate opposite to the gas tank side. In this case, the known nozzle described above is unable to draw in the vapors because they are separated from its intake holes by the restriction plate. Such vapors are not recovered by existing bellowless gasoline dispensing nozzles.

SUMMARY OF THE INVENTION

Broadly speaking, it is an object of this invention to reduce vapor leakage and increase the efficiency with which vapor recovery gasoline dispensing nozzles recapture vapors in vehicles having a gas tank vent tube exiting outside the no-lead restriction plate.

In accordance with the invention, a bellowless gasoline dispensing nozzle comprising two adjacent, preferably coaxial passageways is provided with two sets of vapor intake holes in the recovery spout. The first set of holes is located near the spout tip and serves to draw in vapors from the gas tank side of the no-lead restriction plate, whereas the second set of holes is placed some distance further up the spout so that it can draw in gasoline vapors from the outer side of the no-lead restriction plate.

BRIEF DESCRIPTION OF THE DRAWING

The objects, advantages and features of this invention will be more clearly perceived from the following detailed description, when read in conjunction with the accompanying drawing, wherein:

FIG. 3 is a side, partially cut away view of the gasoline dispensing nozzle of this invention; and FIG. 4 shows the gasoline dispensing nozzle of the invention inserted into a vehicle gasoline tank fill neck with a vent tube opening outside the restriction plate.

DETAILED DESCRIPTION OF THE PREFERRED EMBODIMENT

Figure 1:
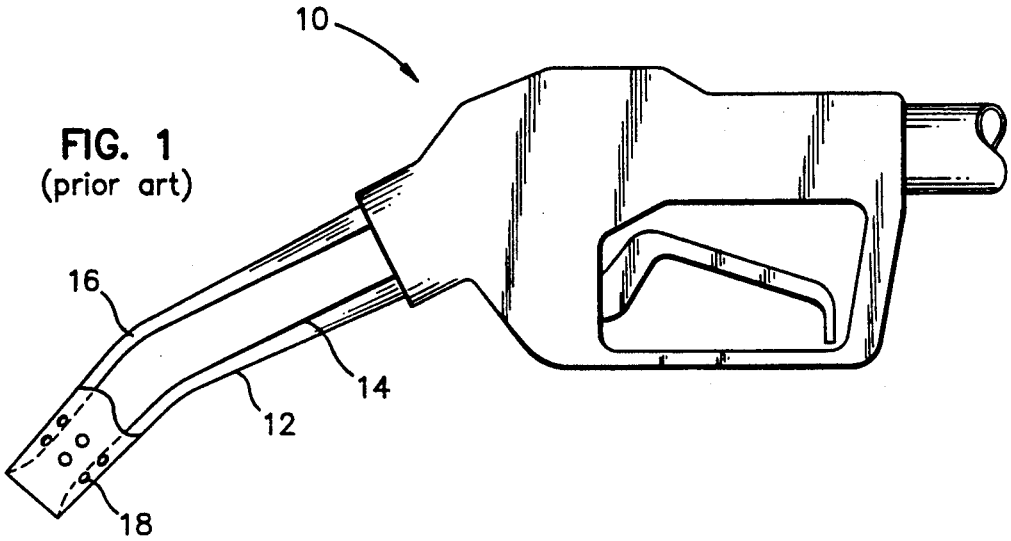
FIG. 1 (prior art)
FIG. 1 is a side view of a bellowless gasoline dispensing nozzle of the type known in the art.
Figure 2:
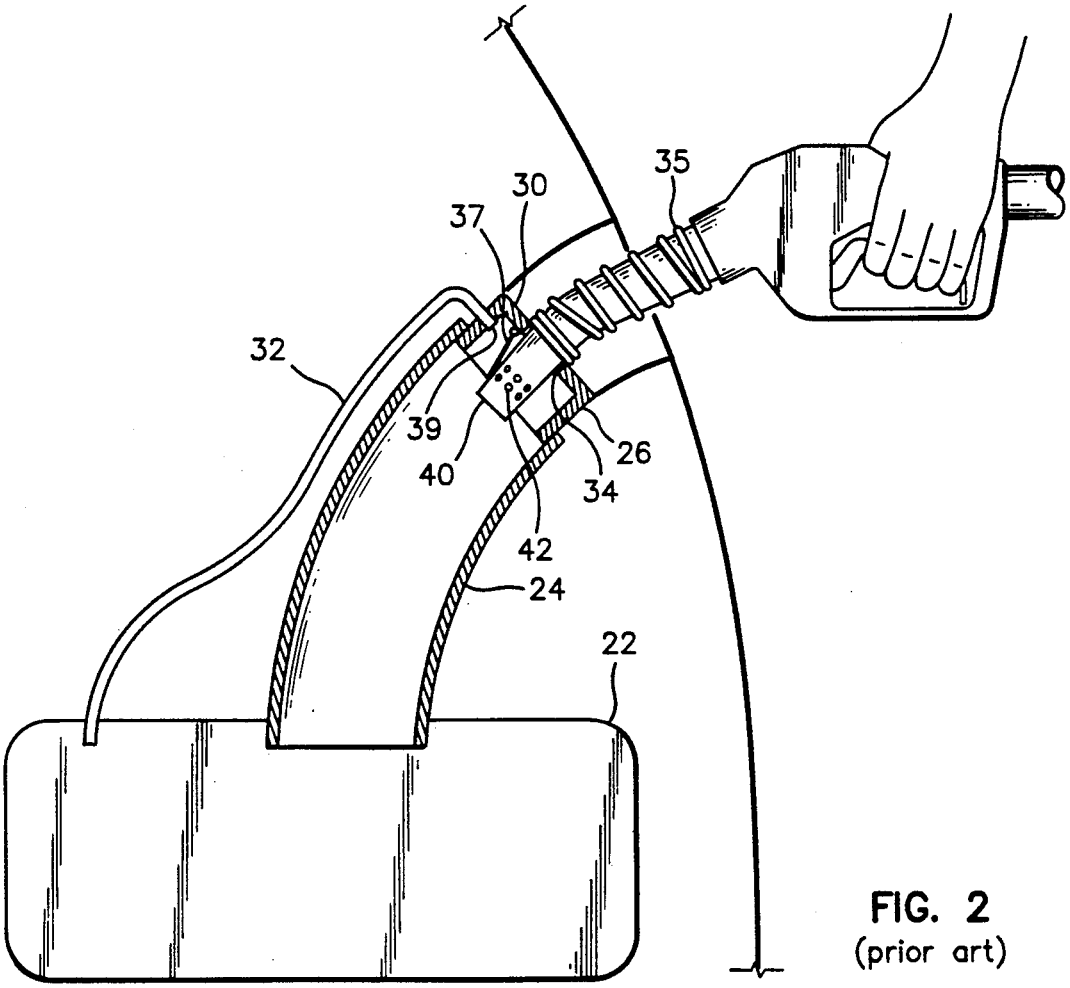
FIG. 2 (prior art)
FIG. 2 shows the nozzle of FIG. 1 in a typical vehicle gasoline fill neck with a vent tube below the restriction plate.

With reference now to the drawing, the prior art shown in FIGS. 1 and 2 has already been adequately described. The nozzle of the invention is shown in FIGS. 3 and 4.

FIG. 3 shows a preferred embodiment of gasoline dispensing nozzle 50 having spout 51 constructed according to this invention. Coaxial tubes 52 and 54 are arranged so as to form a fluid flow passageway inside inner tube 52 and a vapor return passageway in the space 56 between the two tubes. That space is connected to a conventional vacuum system (not shown), which creates a vacuum in space 56 tending to draw vapor in through two sets of holes 58 and 60. Holes 58 are located adjacent the distal end of the spout as in the prior art, whereas holes 60 are located further toward the handle, spaced from the distal end of the spout. Holes 60 are preferably placed so that even when the nozzle is fully inserted into an unleaded gasoline inlet, the holes will lie outside the no-lead restriction plate.

The sets of holes 58 and 60 need not be identical. It may be desirable to dimension these sets of holes in such a way as to adapt to the quantity of vapor needing to be drawn in on either side of the no-lead restriction plate. It may also be desirable to dimension the sets of holes to take into account the pressure drop in passageway 56 between distal holes 58 and second set of holes 60. Test data shows that 25–30% of the vapors vented through an opening outside the trap door in the no-lead restriction plate could be lost if only holes 58 adjacent the end of the spout were employed for vapor recovery. Thus holes 60 may be fewer in number, as few as 25% of the number of holes 58, or there may be the same number but holes 60 could be as much as 75% smaller than holes 60.

FIG. 4 shows the gasoline dispensing nozzle of this invention inserted into a motor vehicle gasoline inlet 62. Gas tank 64 is connected to fill neck 66 via main tube 68.

Fill neck 66 is attached to a no-lead restriction plate 70. Vent tube 72 leads from the top of the fuel tank to opening 74 in the inlet located outside the no-lead restriction plate and hinged trap door 71. Vapors flowing up through main tube 68 are captured by holes 58 in spout 51 of nozzle 50. It is readily apparent that vapors being emitted from opening 74 could not be captured by holes 58 adjacent the distal end of the nozzle. Those vapors flowing through vent tube 72 are captured through holes 60 in the nozzle. Coil spring 79 may be used to prevent spout 51 from entering the fill neck beyond the desired distance.

The fluid and vapor recovery passageways are shown concentric in the drawing figures. That is the preferred embodiment. However, the passageways comprising the dispensing spout could be closely adjacent without being concentric. Further, the invention is not limited to gasoline dispensing nozzles in conjunction with passenger vehicle fuel tanks. It could be used in any situation where liquid is being dispensed and toxic, flammable or other undesirable vapors are generated and should be controlled and recovered.

Other embodiments and modifications of this invention are likely to occur to those of ordinary skill in the art in view of these teachings. The invention is to be limited only by the spirit and scope of following claims.

What is claimed is:

1. A bellowless vapor recovery dispensing nozzle having a distal dispensing end insertable into a motor vehicle gasoline inlet having an apertured restriction plate therein and a liquid source connecting end, said nozzle comprising:

a liquid flow passageway having an opening at the distal end thereof through which the liquid is dispensed, the opposite end of said passageway being coupled to the liquid source end of the nozzle, and means for preventing said distal end from being inserted into said apertured restriction plate beyond a predetermined point;

a vapor recovery passageway adjacent to said liquid flow passageway, said vapor recovery passageway having first holes closely adjacent the opening of said distal end of said first passageway to provide external access to said vapor recovery passageway;

means for connecting said vapor recovery passageway to a vacuum source which creates a vacuum in said vapor recovery passageway to draw vapors out of the passageway; and at least one second hole through the side of said vapor recovery passageway, said second hole being located between said predetermined point and said connecting end of said nozzle to facilitate recovery of vapors that exists in the vicinity of said nozzle and spaced from said distal end thereof.

2. The nozzle recited in claim 1, wherein:

said liquid flow passageway comprises the inner lumen of a pair of coaxial spouts; and said vapor recovery passageway comprises the space between the inner and outer spouts of said pair of coaxial spouts.

3. The nozzle recited in claim 1, wherein said at least second hole is so situated that, when said nozzle is substantially fully inserted into a motor vehicle gasoline inlet having a no-lead restriction plate, said at least one second hole lies on the outward side of said no-lead restriction plate.

4. The nozzle recited in claim 1, wherein said first holes and said at least one second hole are dimensioned to allow for different volumes of vapor to be collected by each set.

5. The nozzle recited in claim 4, wherein said at least one second hole has an opening which is smaller than the total opening area of said first holes.

6. The nozzle recited in claim 5, wherein said at least one second hole has an opening area as much as 75% smaller than the total opening area of said first holes.

7. The nozzle recited in claim 4, wherein said at least one second hole comprises a plurality of second holes, each of a size similar to the size of each of said first holes and being fewer in number with respect to the number of said first holes.

8. The nozzle recited in claim 7, wherein there are at least 25% as many second holes as there are said first holes.

9. The nozzle recited in claim 1, wherein said first holes and said at least one second hole are dimensioned to allow for any additional pressure drop in the vapor recovery passageway between said first holes and said at least one second hole.

10. The nozzle recited in claim 9, wherein said at least one second hole has an opening which is smaller than the total opening area of said first holes.

11. The nozzle recited in claim 10, wherein said at least one second hole has an opening area as much as 75% smaller than the total opening area of said first holes.

12. The nozzle recited in claim 9, said at least one second hole comprises a plurality of second holes, each of a size similar to the size of each of said first holes and being fewer in number with respect to the number of said first holes.

13. The nozzle recited in claim 12, wherein there are at least 25% as many second holes as there are said first holes.

* * * * *